US006739500B1

(12) United States Patent
Gentile et al.

(10) Patent No.: US 6,739,500 B1
(45) Date of Patent: May 25, 2004

(54) CONTAINER AND METHOD FOR MAKING CONTAINER FOR FRAGILE PRODUCTS

(75) Inventors: Mike Gentile, Hartsville, SC (US); Veronique Sins, Zaventem (BE); J. Mark Morrow, Camden, SC (US); James W. Lowry, Florence, SC (US); Kenan Clougherty, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 77 days.

(21) Appl. No.: 09/543,439

(22) Filed: Apr. 5, 2000

(51) Int. Cl.[7] ..... B65D 5/56

(52) U.S. Cl. ..... 229/164.2; 206/524.8; 206/830

(58) Field of Search ..... 206/524.8, 830; 229/164.2; 426/106, 110

(56) References Cited

U.S. PATENT DOCUMENTS 3,779,447 A * 12/1973 Bemiss ..... 206/583
4,087,003 A * 5/1978 Adamek ..... 206/583
4,098,404 A * 7/1978 Markert ..... 206/524.8 X
4,158,425 A 6/1979 Sansbury
4,267,928 A * 5/1981 Curry, Jr. ..... 206/524.8 X
4,466,553 A * 8/1984 Zenger ..... 206/524.8 X
4,542,029 A * 9/1985 Caner et al. ..... 426/110 X
4,557,414 A * 12/1985 Ford et al. ..... 229/5.5
4,637,543 A * 1/1987 Kucherer ..... 229/5.6
4,856,708 A * 8/1989 Giasi ..... 229/125.17
5,285,954 A * 2/1994 Goglio ..... 229/125.14
5,354,569 A * 10/1994 Brown et al. ..... 206/524.8 X
5,829,669 A 11/1998 Drummond et al.
5,950,833 A * 9/1999 James ..... 426/110 X
5,971,259 A 10/1999 Bacon
5,988,493 A 11/1999 Clougherty

* cited by examiner

*Primary Examiner*—Tri M. Mai
(74) *Attorney, Agent, or Firm*—Alston & Bird LLP

(57) ABSTRACT

A tubular container for fragile products is provided according to the present invention that includes a flexible end closure that moves inwardly against the products when vacuum is applied during packaging for providing cushioning support to the products. The flexible end closure is secured to an end of a tubular body wall having opposed ends and inner and outer surfaces and comprises a wound strip of material. A flexible liner having opposed end portions is secured to respective ends of the tubular body by way of an adhesive band between the liner and the inner surface of the tubular body wall. The flexible liner thus has a free medial portion between the end portions which moves inwardly against the products when vacuum is applied. A vent hole may be formed through the body ply and an outer label by way of a laser for allowing the passage of air therethrough.

24 Claims, 6 Drawing Sheets

CONTAINER AND METHOD FOR MAKING CONTAINER FOR FRAGILE PRODUCTS

FIELD OF THE INVENTION

The present invention relates to composite containers, and in particular relates to composite containers for vacuum packaging fragile products, such as potato crisps or cookie biscuits, and associated methods.

BACKGROUND OF THE INVENTION

Food and drink products and other perishable items are often packaged in tubular containers that are sealed at both ends. For some time, it has been recognized that substantial economies, as well as environmental advantages, can be effected by the use of composite containers, as opposed to the traditional glass and metal containers. These composite containers typically include at least one structural body ply made of paperboard and are formed by wrapping a continuous strip of the body ply material around a mandrel of a desired shape to create a tubular structure. The body ply strip may be spirally wound around the mandrel or passed through a series of forming elements so as to be wrapped in a convolute shape around the mandrel. At the downstream end of the mandrel, the tube is cut into discrete lengths and fitted with end caps to form the container.

Tubular containers of this type typically include a liner ply on the inner surface of the paperboard body ply. The liner ply prevents liquids from leaking out of the container and also prevents liquids from entering the container and possibly contaminating the food product contained therein. Preferably, the liner ply is also resistant to the passage of gases so as to prevent odors of the food product in the container from escaping and to prevent atmospheric air from entering the container through the liner and spoiling the food product. The liner ply is often a laminate including kraft paper, aluminum foil and/or one or more polymer layers. Thus, the liner ply provides barrier properties and the body ply provides structural properties for the composite container.

In addition, a label ply is typically included and adhered to the outer surface of the paperboard body ply. The label ply, which is typically a paper based ply, is a source of information. The label carries the graphical matter that conveys product information, instructions, and regulatory compliance information. The label is also preferably decorative and aesthetically pleasing to the consumer, which enhances shelf appeal and increases consumer interest in the food product.

Certain food products benefit from being packaged while under a vacuum. Vacuum packaging removes oxygen from the space surrounding the product, which can improve the shelf life of the product within the package. This is especially true for perishable food products, or food products that may become stale if exposed to air. However, it is generally recognized that vacuum packaging in some tubular containers can only be accomplished with difficulty, if at all. Because of the structural design of the composite container, the application of vacuum to the interior of the container often results in partial or complete inward collapsing of the container walls along the length of the container. This can result in an unacceptable appearance for the composite container or an unacceptable sealing of the product within the container.

This problem is further discussed in U.S. Pat. No. 4,158,425, assigned to the assignee of the present invention and herein incorporated by reference. To avoid the partial or complete collapsing of the paperboard body ply of the container upon application of a vacuum inside the container, the container according to the '425 patent has an impermeable or hermetically sealed liner secured interiorly to the container body solely at the opposed ends thereof with the major length of the liner being free of the tubular body so as to allow an inward contracting of the liner without the introduction of excessive stresses to the container body itself. A vacuum or reduced pressure atmosphere within the liner causes an inward deformation of the liner into contact with the product substantially independently of the surrounding container body. Thus, the stresses which are transferred to the container body are at the opposed ends thereof which are in turn rigidified by a pair of conventional end caps.

The '425 patent, however, only addresses the problem of collapsing of the container walls. The '425 patent does not discuss or provide a container designed to secure the food products during transportation. In particular, fragile food products, such as potato crisp or cookie biscuits, are extremely susceptible to breakage during transportation. These types of products are typically stacked within the container such that the products can move about the container during transportation. Although the '425 patent provides an inwardly moving liner, it is directed to sealing the product for freshness without damaging the tubular body, and not directed to providing cushioning support to the food products in order to prevent damage during transportation.

Accordingly, there is a great need in the industry for a container that hermetically seals perishable food products, but that is also capable of protecting fragile food products during transportation. At the same time, however, such a container would also be capable of withstanding the rigors of vacuum packaging so as to increase the shelf life of the product and provide other benefits attendant to vacuum packaging.

SUMMARY OF THE INVENTION

These and other needs are provided, according to the present invention, by a tubular container having a flexible end closure secured to at least one of the opposed ends of the container that is free to move inwardly against food products contained therein when a vacuum is applied so as to provide cushioning support to the food products. As such, the food products are supported by a "pillow-like" cushion instead of a spaced metal end closure or other rigid surface as provided by current containers, thus preventing damage to the food products during transportation or inadvertent movement before the container is opened.

In particular, the container for vacuum packaging fragile food products, such as potato crisps, cookie biscuits, or baked wafers, includes a tubular body wall having opposed ends and inner and outer surfaces. The tubular body is formed using conventional spiral winding techniques known in the art, such as described in U.S. Pat. No. 4,158,425, which is assigned to the assignee of the present invention and herein incorporated by reference.

In one embodiment, a flexible liner that is impervious to the passage of liquids and gasses is also included. The flexible liner is secured to the respective ends of the tubular body by way of an adhesive band between the liner and the inner surface of the tubular body wall adjacent each end of the tubular body wall. As such, a free medial portion is defined between the opposed end portions of the liner that is free to move inwardly from the tubular body wall when vacuum is applied and then to move outwardly toward the inner surface of the tubular body wall when the container is opened and vacuum is lost. Although not necessary to practice the invention, the liner preferably comprises a flexible and stretchable liner formed of at least one polymeric layer without foil and paper layers. Other types of liner materials may also be used, such as liners comprising polymer/foil, kraft paper/foil/polymer, or kraft paper/foil laminates. Accordingly, the liner can move inwardly to substantially form to the contours of the food products contained therein, thus providing not only a hermetic seal but also cushioning support to the food products. In this manner, the vacuum created during packaging does not act directly on the body wall thus preventing inadvertent collapse of the body wall. When the container is opened, the vacuum is lost and the liner moves away from the food products such that the products may be removed. A label surrounds the outer surface of the body wall.

A vent hole can be formed through the body wall and the label, such as with a laser, for allowing the passage of air therethrough. The vent allows the medial portion of the liner to move inwardly against the food products and allows air to enter the cavity formed between the liner and the tubular body when vacuum is applied.

Advantageously, a flexible end closure is secured to at least one of the opposed ends of the tubular body. The flexible end closure moves inwardly against the food products contained within the tubular body when vacuum is applied so as to provide cushioning support to the food product. The flexible end closure includes a foil layer that is impervious to the passage of liquids and gasses, and in one embodiment, two flexible end closures are included for providing even further cushioning support to the food products.

Associated methods also form a part of the invention and, according to one embodiment, include the steps of forming a tubular body wall with opposed ends and a flexible liner adjacent the inner surface of the body wall, closing one end of the tubular body wall, and depositing the food products within the liner and tubular body wall. The vacuum packaging operation can then be performed by applying a negative pressure to the open end of the tubular body and then closing the open end of the tubular body with the flexible end closure. The negative pressure is then released such that the flexible liner is moved inwardly from the inner surface of the body wall against the food products, and the flexible end closure moves inwardly against the food products to provide cushioning support therefor.

Accordingly, and as is explained in more detail below, the Applicants have provided a new container for fragile food products which overcomes the disadvantages of conventional containers. The present invention is particularly advantageous for food products that are easily damaged during transportation, such as potato crisps or cookie biscuits. The new container is easy to open for consumers, and can use conventional body wall and label construction techniques, such as an overlapping or anaconda seam. At the same time, however, the present container is capable of withstanding the rigors of vacuum packaging so as to maintain a rigid shape and provide a hermetically sealed container to prevent air and moisture from contaminating the food products contained therein.

BRIEF DESCRIPTION OF THE DRAWINGS

While some of the objects and advantages of the present invention have been stated, others will appear as the description proceeds when taken in conjunction with the accompanying drawings, which are not necessarily drawn to scale, wherein.

DETAILED DESCRIPTION OF THE INVENTION

Figure 1:
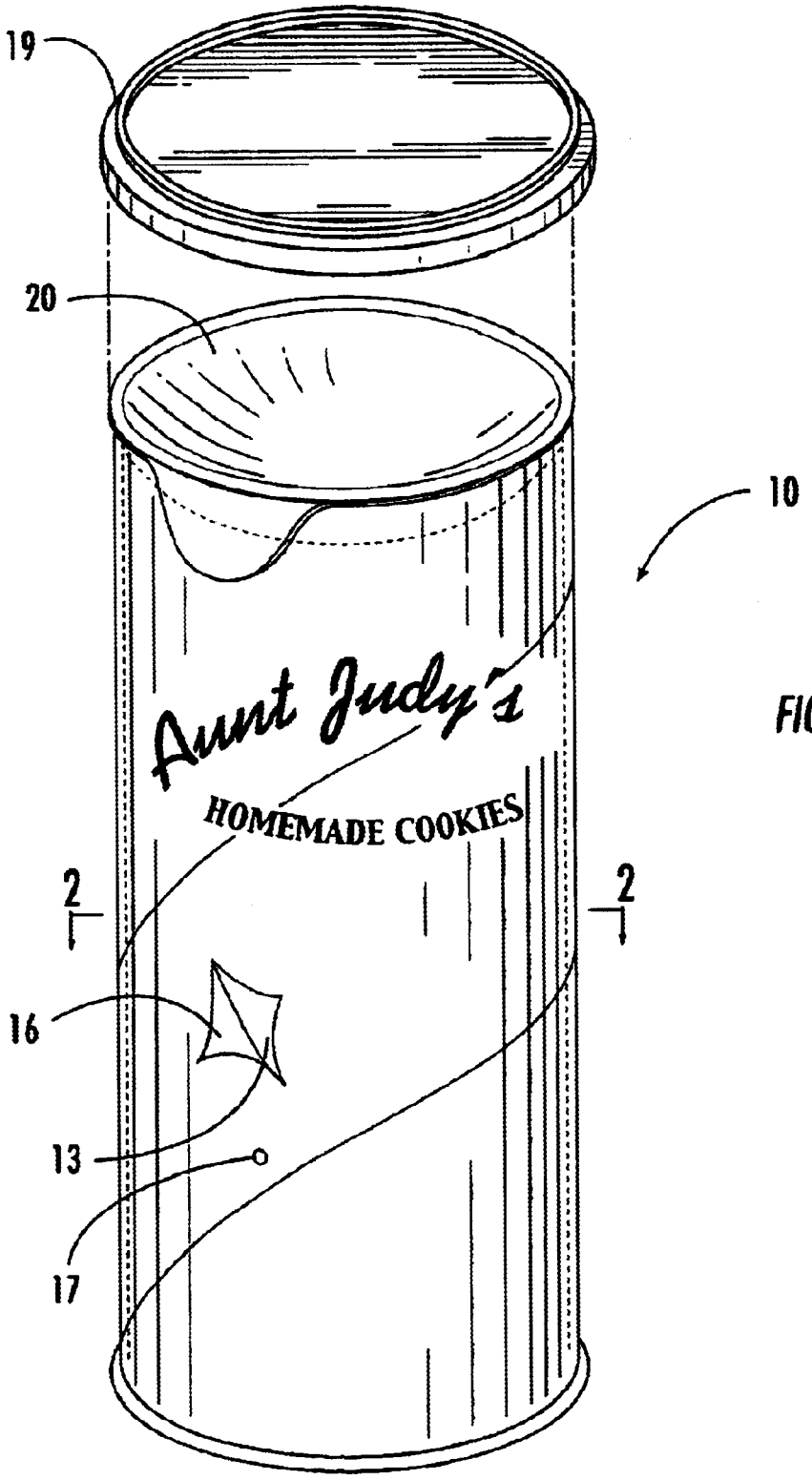
FIG. 1 is a perspective view of a container of the present invention.
Figure 2:
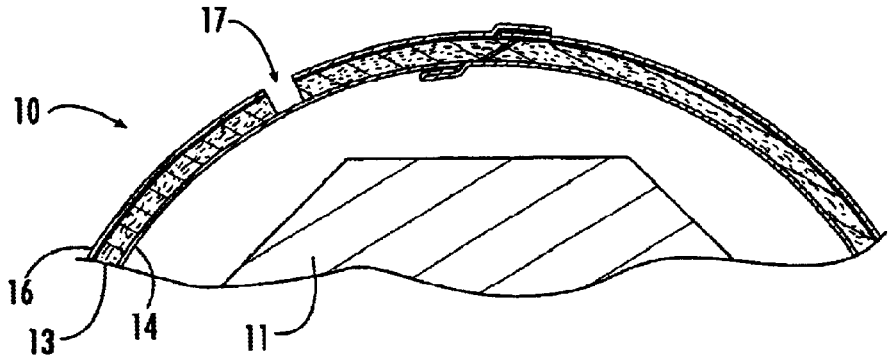
FIG. 2 is a greatly enlarged sectional view of the container of the present invention as seen along lines 2—2 of FIG. 1 shortly before the vacuum packaging operation.
Figure 3:
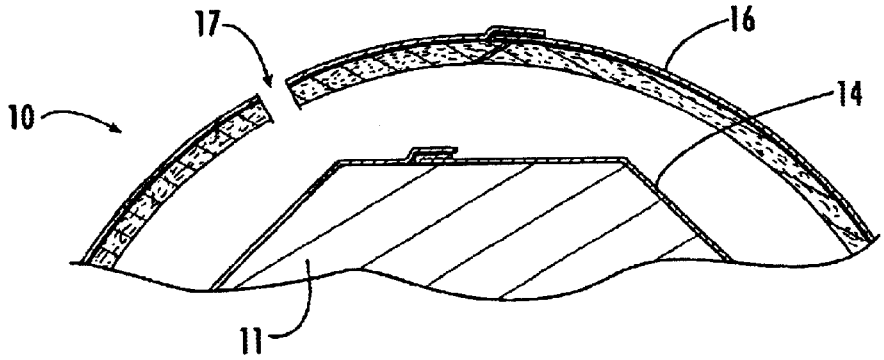
FIG. 3 is a greatly enlarged sectional view of the container of the present invention as seen along lines 2—2 of FIG. 1 shortly after the vacuum packaging operation.
Figure 4:
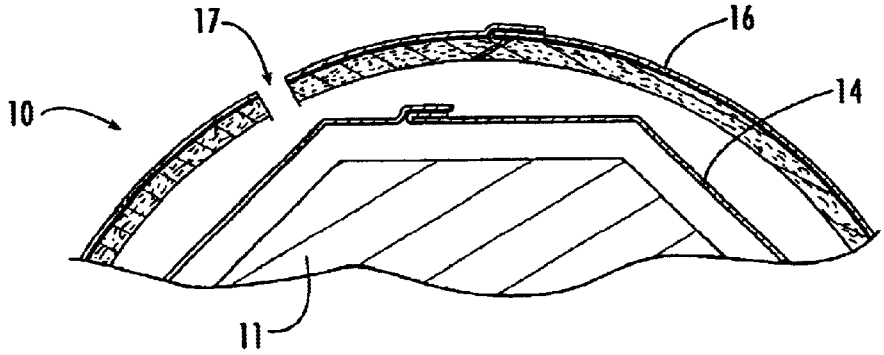
FIG. 4 is a greatly enlarged sectional view of the container of the present invention as seen along lines 2—2 of FIG. 1 shortly after the vacuum is lost.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Turning first to FIGS. 1–5, a tubular container 10 is illustrated and is particularly advantageous for vacuum packaging fragile food products 11, such as potato crisps or cookie biscuits having multi-sided shapes. Other food products that may break during transportation or rough handling after packaging are crackers, wafers, and the like.

Although illustrated as having a circular cross section, the tube of the container 10 may have any cross sectional shape that can be formed by wrapping the tube around an appropriately shaped mandrel. One example is a generally rectangular shaped tube having rounded corners. As illustrated in more detail in FIGS. 2–4, the tubular container 10 includes a body wall comprising at least one body ply 13 that is preferably formed of a strip of paperboard. In one embodiment, the tubular container 10 also includes a liner ply 14 comprising a polymeric material and adhered to the inner surface of the body ply 13. Other materials may also be included, such as kraft paper and/or foil. A label ply 16 is adhered to the outer surface of the body ply 13. The label ply 16 is conventionally constructed from materials known in the art, such as kraft paper, polymers, or the like. In addition, a cap 19 may be secured to an end of the container 10.

The body ply 13 may be advantageously composed of conventional spiral-winding paperboard having a thickness of about 0.15–0.30 inch, and preferably about 0.20 inch. Such a body ply 13 is described in U.S. Pat. No. 5,988,493, which is assigned to the assignee of the present invention and is herein incorporated by reference.

The liner ply 14 is typically constructed of multiple layers. Preferably, one of the layers forms a barrier to moisture and/or gasses. It will be understood that various barrier materials and liner plies could be employed depending upon the item being packaged. However, in a preferred embodiment, the liner ply 14 is substantially entirely formed of polymeric material. In particular, liner plies such as described in U.S. Pat. No. 5,829,669, which is assigned to the assignee of the present invention and is hereby incorporated by reference, may be used.

The barrier layer of the liner ply 14 is resistant to the passage of liquids and gasses such as oxygen. If a high barrier is required for both liquids and gasses, preferred barrier materials are metallized polyester or metallized polypropylene. It will be understood that various barrier materials could be employed depending upon the food products 11 being packaged. One surface of the barrier layer may include a thin metallized coating to provide a metallic appearance and also to enhance the barrier properties. The metallized coating, which may be formed of aluminum, is significantly thinner than a foil layer, however, and is not necessary for strength or barrier properties in certain applications. It is to be understood that the liner ply 14 is not required for some types of food products 11. However, the liner ply 14 provides an added cushioning support when vacuum is applied that is desirable in most circumstances.

Figure 5:
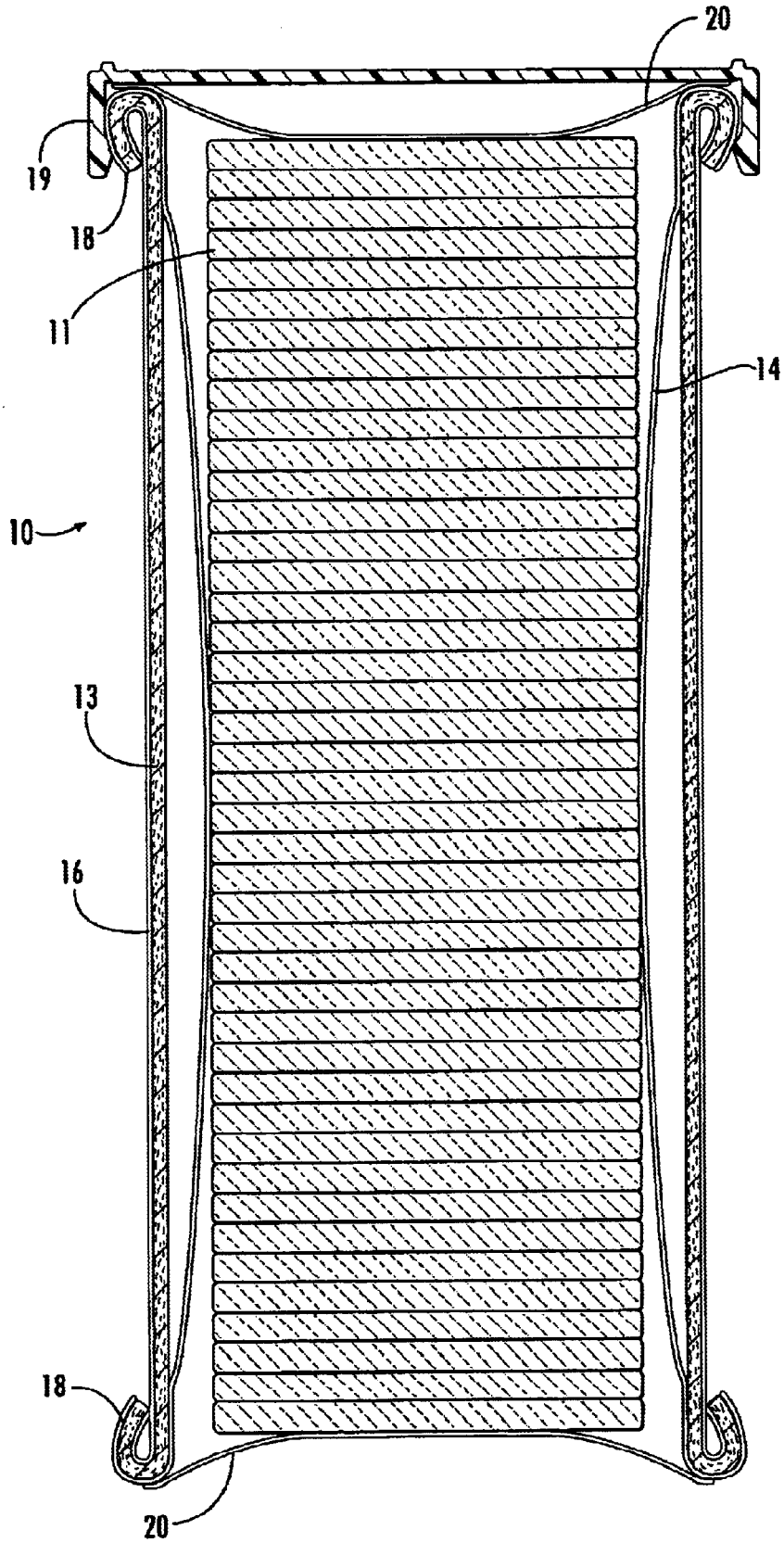
FIG. 5 is a sectional view of the container having a liner ply according to the present invention.
Figure 6:
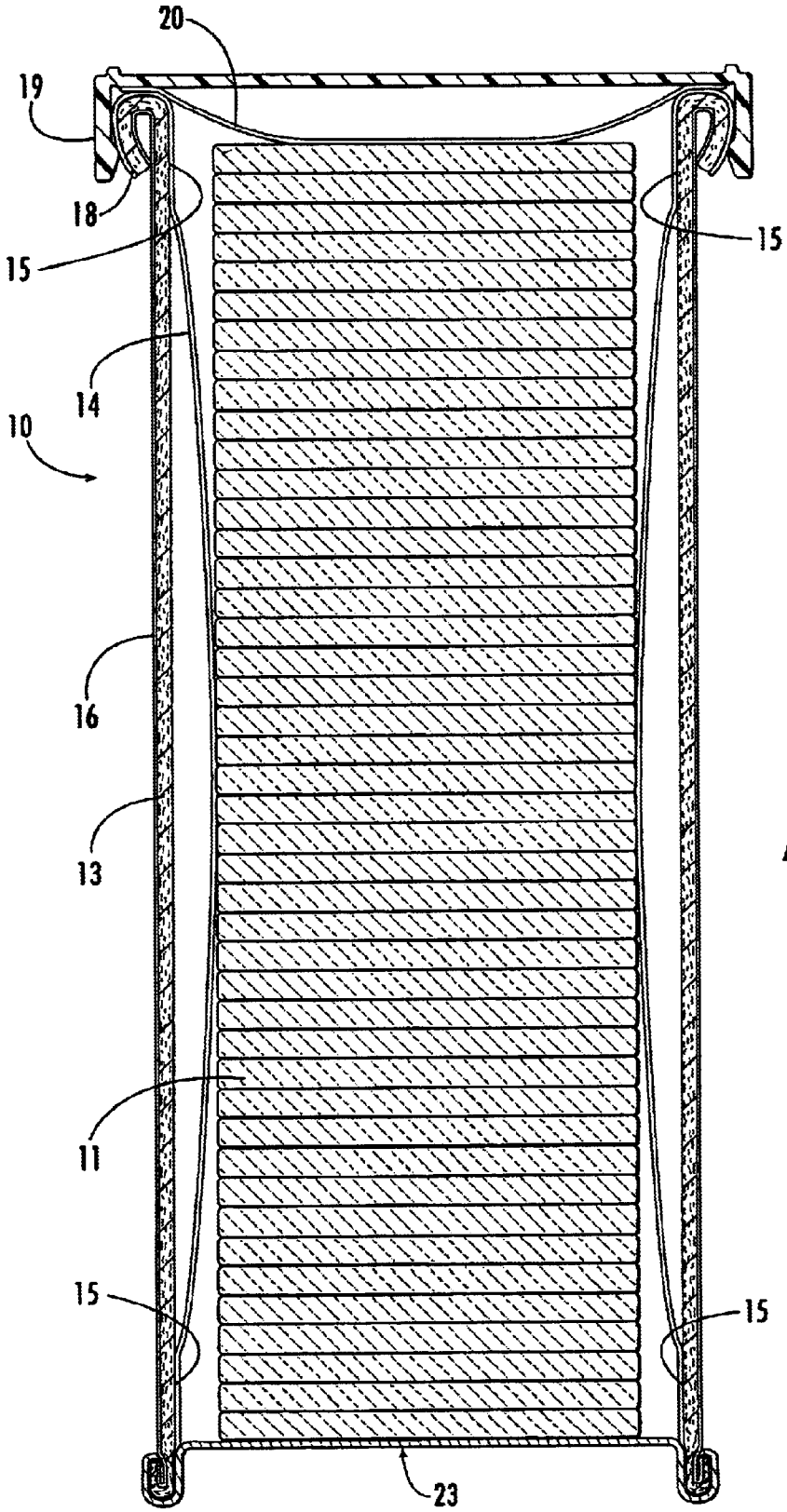
FIG. 6 is a sectional view of another embodiment of the container according to the present invention.
Figure 7:
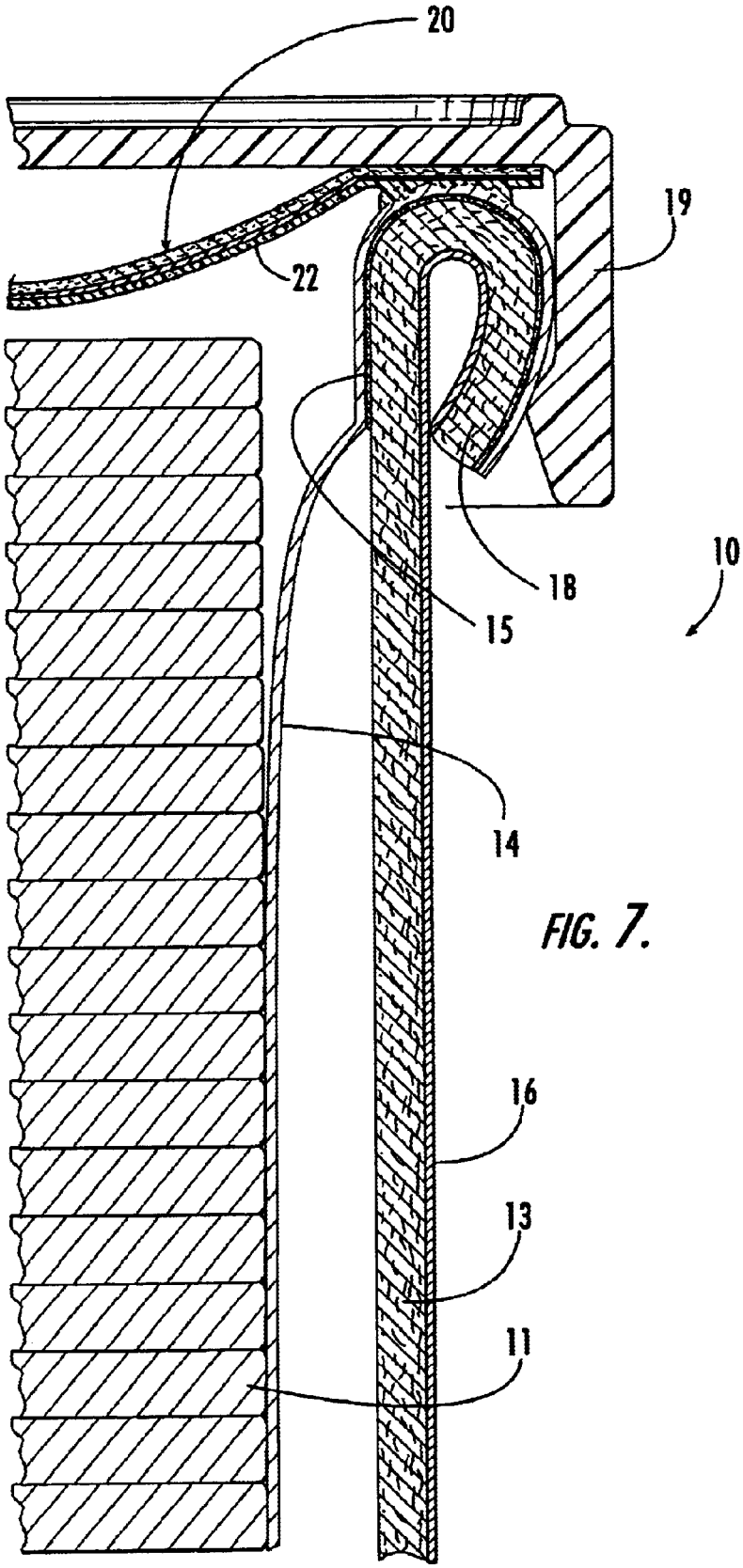
FIG. 7 is a greatly enlarged sectional view of a portion of the container seen in FIG. 5.

FIGS. 5–7 show sectional views of the tubular container 10 wherein the axially opposed end portions of the liner ply 14 are adhered to the inner surface of the body ply 13 by a pair of adhesive bands 15. The adhesive bands 15 are separated such that a medial portion of the liner ply 14 between the axially opposed end portions remains free and unattached to the body ply 13. Accordingly, after the food products 11 have been placed inside the cavity defined by the body ply 13, the cavity is subjected to a vacuum and the unattached medial portion of the liner ply 14 will be withdrawn against the food products 11.

Advantageously, the present invention also includes a flexible end closure 20 (sometimes referred to as a "membrane") that is affixed to an end of the tubular container 10. The other end closure 23 of the tubular container 10 (see FIG. 6) may be constructed of steel or aluminum plate with applied coatings and/or electrolytic tinplate. The invention is not limited to one flexible end closure 20, however, as two flexible end closures 20 may be affixed to respective ends of the tubular container 10 (see FIG. 5). The flexible end closure 20 is preferably made of a flexible laminate made of films, kraft paper, foil, and/or extruded polymers and is heat sealed or adhesively attached to the end of the tubular container 10.

In particular, the flexible end closure 20 includes a barrier layer that serves as a barrier to the passage of liquids and/or gasses such as oxygen. If a barrier is required for both liquids and gasses, the barrier material is preferably selected from the group consisting of metal foil, such as aluminum foil, polyethylene terephthalate, modified polyethylene terephthalate, polyethylene napthalate, polyamide, metallized and silicate coated polyester, metallized and silicate coated polypropylene, metallized polyamide, polyvinylidiene chloride, ethylene vinyl alcohol, and mixtures thereof. Other layers may be disposed on the outermost surface of the flexible end closure 20 away from the inside of the tubular container 10, including paper or paperboard layers, such as a kraft paper layer.

In one embodiment, the flexible end closure 20 further includes a seal layer 22 (see FIG. 7) comprising a heat sealable composition and positioned such that the seal layer 22 of the flexible end closure 20 is adjacent the liner ply 14. The seal layer 22 of the flexible end closure 20 is preferably constructed of a material selected from the group consisting of ethylene vinyl acetate, ionomeric polymers, such as SURLYN® polymer, high density polyethylene, low density polyethylene, ethylene methyl acrylate, metallocene catalyzed polyolefins and mixtures or blends thereof. The seal layer 22 of the flexible end closure 20 preferably has a melting point within the range of about 70° C. and 130° C. More preferably, the melting point of the seal layer 22 is between about 80° C. and 110° C.

A preferred construction of the seal layer is disclosed in U.S. patent application Ser. No. 09/416,194, filed Oct. 12, 1999, entitled "Sealant Layer for Container Lid." This application is assigned to the assignee of the present invention and is herein incorporated by reference.

An alternative end closure that can be used comprises a steel or aluminum flanged rim with applied coatings and/or electrolytic tinplate with a center panel of a flexible laminate made of films, foil, and/or extruded polymers and having a tab extending therefrom for grasping by the consumer. Such an end closure is sold under the trademark ULTRASEAL® from Sonoco Products Company.

U.S. Pat. No. 4,158,425 (discussed above) discloses a composite container comprising a tubular body and an inner liner coextensive with the length of the tubular body and affixed by adhesive to the opposed ends thereof. Opposed end caps are hermetically sealed on the ends of the container such that a vacuum can be drawn internal to the inner liner. However, the end caps do not move inwardly toward the food products when vacuum is applied in order to provide cushioning support to the food products located therein. Thus, upon a vacuum being applied the liner is withdrawn against the food products, but the end closures remain rigid. Thus, the container of this patent may not provide sufficient protection for fragile food products, such as potato crisps and cookie biscuits, that may be easily damaged during transportation. In particular, the end closures of the '425 patent may not absorb impacts from the food products packaged within the container caused during transportation, thus leading to broken food products, which is undesirable to consumers.

Advantageously, unlike the '425 patent, the present invention allows for the packaging of fragile food products 11, and, in particular, the packaging of fragile food products under a vacuum. As discussed above, fragile food products such as potato crisps and cookie biscuits are particularly disposed to breakage during transportation, where rough handling and jostling occur that may cause the food products 11 to hit against the inside of the container 10. With the present invention, the flexible end closure 20 readily accommodates the jostling of the food products 11 by moving inwardly against the food products when vacuum is applied, thus creating a pillow-like cushioning support to the food products and preventing accidental breakage of the food products. The position of the flexible end closure 20 when vacuum is applied is shown in FIGS. 5–7. In one advantageous embodiment shown in FIG. 5, two flexible end closures 20 may be included at respective ends of the container 10 for providing further cushioning support to, the food products 11. However, the invention is not limited to two flexible end closures, as one flexible end closure may be used in conjunction with a metal end closure 23 that is secured to an opposite end of the container 10 (see FIG. 6).

The medial portion of the liner ply 14 also moves inwardly against the food products 11 when vacuum is applied, which further adds cushioning support to the food products. For example, where the food products 11 have a multi-sided shape, the liner ply 14 moves against the food products 11 such that the liner ply substantially conforms to the contours, i.e., the multi-sided shape, of the food products, thus preventing the food products from moving within the liner ply. Therefore, under vacuum the liner ply 14 substantially prevents the food products 11 from moving in a radial direction in relation to the container 10, and the flexible end closure 20 substantially prevents the food products from moving in an axial direction in relation to the container. If jostling occurs before the vacuum is lost, such as by opening the container 10, the flexible end closure 20 and the liner ply 14 absorb the impact forces of the food products 11 caused by the jostling such that the food products remain unbroken. The positions of the liner ply 14 and flexible end closure 20 while under vacuum can be seen in FIGS. 5–7.

Figure 8:
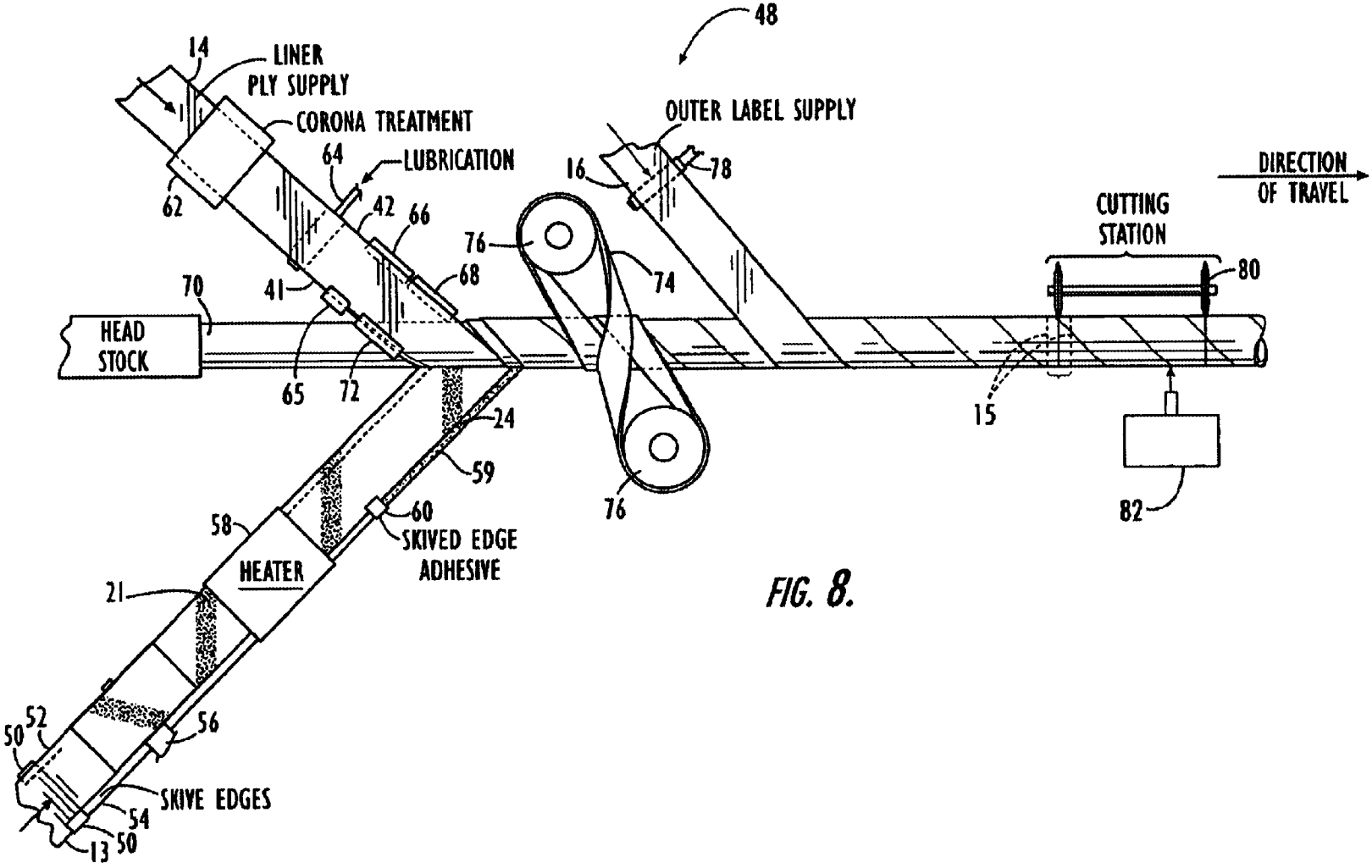
FIG. 8 is a view of an embodiment of an apparatus for making a tubular container according to the present invention.

The container 10 of the present invention may be manufactured by the process illustrated in FIG. 8. As shown, a continuous strip of paperboard body ply material 13 is supplied to the apparatus 48 and is first passed through a pair of opposed edge skivers 50. The edge skivers remove part of the square edge of the body ply 13 to create first 52 and second 54 edges having a beveled configuration. The body ply 13 is then advanced through an adhesive applicator 56, which applies an adhesive 21 to the upper surface of the body ply 13. The adhesive 21 is advantageously an aqueous adhesive, which overcomes the many problems associated with solvent-based adhesives. No special equipment is needed to capture solvents that evaporate from the adhesive in order to comply with environmental regulations. Preferred adhesives are aqueous low glass transition temperature ethylene vinyl acetate (>18%) materials. One preferred adhesive is No. 72-4172, which is available from the National Starch and Chemical Company. Another adhesive that may be used is No. 33-4060, which is also available from the National Starch and Chemical Company. The adhesive 21, as well as other adhesive layers used to construct the container 10, may be applied in the form of a foam as described in copending U.S. patent application Ser. No. 09/197,275 entitled, "Composite Container Having Foamed Adhesive," which is assigned to the assignee of the present invention and hereby incorporated by reference.

The body ply 13 and wet adhesive 21 applied thereto may then be passed underneath a heater 58 which evaporates at least part of the water content of the aqueous adhesive 21 to render the adhesive substantially tacky. It is important that the correct amount of heat is supplied to the adhesive. Insufficient heat will not evaporate enough water in a sufficiently short period of time with the result that the adhesive will not be rendered sufficiently tacky. Conversely, too much heat will overdry the adhesive and cause the adhesive to lose tackiness. A preferred type of heat source is an infrared heater although various other heat sources, e.g., forced air heating or the like can be used.

After heating the adhesive 21 on the body ply 13, the body ply 13 and the liner ply 14 are fed to the shaping mandrel 70 from opposite directions. The body ply 13 is passed under skive adhesive applicator 60 which applies the skive adhesive 59 to the beveled surface of the skived second edge 54 of the body ply 13. The skive adhesive 59 is preferably a hot melt adhesive of the type which is conventional in the art, although it could also be a water based adhesive including one or more polymers. Polyvinyl acetate and ethylene vinyl acetate are the preferred liquid adhesives. The skive adhesive 59 helps provide a stronger body ply bond especially for single body ply containers.

If the liner ply 14 is of a polymeric type material, the surface of the liner ply that contacts the body ply 13 may be subjected to a corona treatment station 62. The opposite surface of liner ply 14 is coated with lubricant from a roller 64, which allows the liner ply to slide smoothly during the winding operation. The liner ply 14 is then passed through an edge folder 65, which folds over the first marginal edge portion 41 to create an anaconda fold in the liner ply, and adjacent to an infrared heater 66, which heats the second marginal edge portion 42 of the liner ply. After the infrared heater 66, the second marginal edge portion 42 of the liner ply 14 is then passed adjacent to at least one forced air heater 68.

The body ply 13 and the liner ply 14 are then wrapped around the shaping mandrel 70 from opposite sides of the mandrel. Each ply is first wrapped under the mandrel 70 and then back over the top in a helical fashion with the liner ply 14 wound against the surface of the mandrel. The first marginal edge portion 41 of the liner ply 14 is exposed on the mandrel 70 and is subjected to heat from a second forced air heater 72.

As the body ply 13 is further wrapped and the first edge 52 of the body ply 13 advances back under the mandrel 70 after one complete revolution, it is brought into contact with the second edge 54 of the ensuing portion of the body ply 13 which is first coming into contact with the mandrel. The skived edges 52, 54 become overlapped and the skive adhesive 59 adheres the edges together to form a spirally wound tube which advances along the mandrel 70.

With regard to the liner ply 14, the first marginal edge portion 41 is brought into an overlapping relationship with the second marginal edge portion 42 to create a sealed anaconda seam. The seal is formed by polymeric seal layers of the first and second marginal edges 41, 42 becoming bonded to each other. However, a strip of hot melt adhesive or other adhesives and methods could alternatively be used for securing and sealing the liner overlap.

The tube is then advanced down the mandrel 70 by a conventional winding belt 74, which extends around a pair of opposed pulleys 76. The winding belt 74 not only rotates and advances the tube, but also applies pressure to the overlapping edges of the body ply 13 and liner ply 14 to ensure a secure bond between the respective ply edges.

An outer label ply 16 is then preferably passed over an adhesive applicator 78 and wrapped around the body ply 13. The label ply 16 could be applied before the winding belt 74. At a cutting station 80, the continuous tube is cut into discrete lengths and removed from the mandrel 70. The cut is positioned to divide the adhesive strips created by the applicator 56 so as to create the adhesive bands 15 for the opposite ends of successive containers.

A rapid application of vacuum could cause problems with the body ply 13. In particular, the volumetric decrease of the liner ply 14 creates a negative pressure in the cavity between the exterior surface of the liner ply 14 and the inner surface of the body ply 13. This creates a pressure differential across the body ply 13 that could cause a collapse of the body ply 13. Advantageously, a vent hole 17 is provided through the body ply 13 and the label ply 16 of the present invention to allow air to fill the cavity between the exterior surface of the liner ply 14 and the inner surface of the body ply 13. The vent hole 17 thus alleviates the pressure differential on the body ply 13 and prevents collapse of the body ply. The vent hole 17 can be formed at the cutting station 80 with a laser device 82 which is intermittently pulsed to burn a hole through the label ply 16 and body ply 13 for each container length. Other venting arrangements are also possible, such as by a slot or a series of dots cut through the label ply 16 and the body ply 13.

The end closures are then attached to the ends of the tubular body ply 13. At least one of the ends of the container 10 is rolled outwardly to form a rim 18 which provides a suitable surface for affixing the flexible end closure 20. Another end closure, such as a metal closure or a flexible end closure as described above, is attached to the other end of the container 10. Typically, the metal end closure is applied to one end of the container 10 prior to filling of the container with the food products 11. A preferred metal end closure is disclosed in U.S. Pat. No. 5,971,259, which is assigned to the assignee of the present invention and herein incorporated by reference. The metal end closure can be provided with a sealing compound to effect a hermetic seal if desired. Alternatively, two flexible end closures 20 may be affixed to the container 10 by rolling the ends of the container outwardly to form rims on both ends of the tubular body ply 13.

After filling with the food products 11, a vacuum is applied to the open end of the container 10 that removes at least a part of the air remaining within the cavity defined by the liner ply 14 and the attached end closure. Before the vacuum is released, another end closure is applied to the opposing end of the tubular body. The vacuum is then released, causing the flexible end closure 20 to move inwardly towards the food products 11, thus providing the pillow-like cushioning support as described above. In one embodiment, the vacuum applied is less than 30 inches of Hg. Preferably, the vacuum applied is about 8–15 inches of Hg, and more particularly about 12–15 inches of Hg. On the other hand, the type of container described in U.S. Pat. No. 4,158,425 typically includes a vacuum of 30 inches of Hg or more. The type of container described in the '425 patent is designed for less fragile products, such as ground coffee or hot filled juice. Advantageously, the present invention allows for lower amounts of vacuum than the '425 patent, which is particularly important for fragile food products 11. More specifically, high amounts of vacuum may cause the liner ply 14 to crush the fragile food products 11 contained therein, and may further cause the flexible end closure 20 to overflex inwardly and break the seal between the flexible end closure and the body ply 13.

When the container 10 is opened by the consumer, the vacuum maintained inside the liner ply 13 and flexible end closure 20 is lost, causing the liner ply to withdraw somewhat from the food products 11. This withdrawal of the liner ply 14 frees the food products 11 from being trapped by the liner ply and helps in removal of the food products from the container 10. The flexible end closure 20 is then typically fully removed by the consumer and thrown away. If more than one flexible end closure is used, the remaining end closure returns to a generally flat shape substantially perpendicular to the length of the container 10. The food products 11 can then be removed by the consumer.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. For example, the tubular containers according to the present invention are not necessarily helically wound but may instead be longitudinally wrapped to create a "convolute" tube having an axially extending seam. In addition, although the tubular containers according to the present invention have been described primarily in connection with fragile food products, it is to be understood that the containers could be used in connection with other products where a flexible end closure is advantageous, including products other than food which may be fragile (such as wine glasses or Christmas tree ornaments) or otherwise benefit from being stabilized within a container. Although specific terms are employed herein, they are used in a generic and descriptive sense only and not for purposes of limitation.

That which is claimed:

1. A container for vacuum packaging products that may otherwise be damaged during transportation, said container comprising:

a tubular body wall having opposed ends and inner and outer surfaces and comprising a wound strip of material;

a flexible liner having opposed end portions secured to respective ends of the tubular body wall and a free medial portion between the opposed end portions of the liner, said medial portion of said flexible liner being free to move inwardly against the product when vacuum is applied so as to provide cushioning support to the product; and a flexible end closure secured to at least one of the opposed ends of said tubular body wall, said flexible end closure being free to move inwardly against the product when vacuum is applied so as to provide cushioning support to the product.

2. A container according to claim 1, wherein said flexible end closure comprises a foil layer.

3. A container according to claim 1, further comprising an adhesive band between the liner and the inner surface of the tubular body wall adjacent each end of the tubular body wall for securing the opposed end portions of the liner to the tubular body wall.

4. A container according to claim 1, further comprising a metal end closure secured to the end of said tubular body wall opposite said flexible end closure.

5. A container according to claim 1, wherein two flexible end closures are secured to the opposed ends of the tubular body wall.

6. A container according to claim 1, wherein the container is hermetically sealed.

7. A container according to claim 1, wherein the tubular body wall defines a vent for allowing air to enter the cavity between the flexible liner and the inner surface of the tubular body wall.

8. A container according to claim 1, wherein said liner comprises a flexible and stretchable liner of at least one polymeric layer without foil and paper layers.

9. A container for packaging products that may otherwise be damaged during transportation, said container comprising:

a tubular body wall having opposed ends and inner and outer surfaces and comprising a wound strip of material;

a first flexible end closure secured to one of the opposed ends of the tubular body; and a second flexible end closure secured to the other of the opposed ends of the tubular body, said first and second flexible end closures being free to move inwardly against the product when vacuum is applied so as to provide cushioning support to the product.

10. A container according to claim 9, wherein said first flexible end closure comprises a foil layer.

11. A container according to claim 9, wherein the container is hermetically sealed.

12. A container according to claim 9, further comprising a flexible liner having opposed end portions secured to respective ends of the tubular body wall and a free medial portion between the opposed end portions of the liner, wherein the tubular body wall defines a vent for allowing the passage of air therethrough.

13. A vacuum packaged container containing a product, said container comprising:

a tubular body wall having opposed ends and inner and outer surfaces and comprising a wound strip of material;

at least one product having a predefined shape and being positioned within said tubular body wall;

a flexible liner having opposed end portions secured to respective ends of the tubular body wall and a free medial portion between the opposed end portions of the liner, said medial portion of said flexible liner being free to move inwardly against the product when vacuum is applied so as to provide cushioning support to the product without changing the predefined shape of the product; and a flexible end closure secured to at least one of the opposed ends of said tubular body wall, said flexible end closure being free to move inwardly against the product when vacuum is applied so as to provide cushioning support to the product without changing the predefined shape of the product.

14. A vacuum packaged container according to claim 13, wherein said flexible end closure comprises a foil layer.

15. A vacuum packaged container according to claim 13, further comprising an adhesive band between the liner and the inner surface of the tubular body wall adjacent each end of the tubular body wall for securing the opposed end portions of the liner to the tubular body wall.

16. A vacuum packaged container according to claim 13, further comprising a metal end closure secured to the end of said tubular body wall opposite said flexible end closure.

17. A vacuum packaged container according to claim 13, wherein two flexible end closures are secured to the opposed ends of the tubular body wall.

18. A vacuum packaged container according to claim 13, wherein the container is hermetically sealed.

19. A vacuum packaged container according to claim 13, wherein the tubular body wall defines a vent for allowing air to enter the cavity between the flexible liner and the inner surface of the tubular body wall.

20. A vacuum packaged container according to claim 13, wherein said liner comprises a flexible and stretchable liner of at least one polymeric layer without foil and paper layers.

21. A vacuum packaged container containing a product, said container comprising:

a tubular body wall having opposed ends and inner and outer surfaces and comprising a wound strip of material;

at least one product having a predefined shape and being positioned within said tubular body wall;

a first flexible end closure secured to one of the opposed ends of the tubular body; and a second flexible end closure secured to the other of the opposed ends of the tubular body, said first and second flexible end closures being free to move inwardly against the product when vacuum is applied so as to provide cushioning support to the product without changing the predefined shape of the product.

22. A vacuum packaged container according to claim 21, wherein said first flexible end closure comprises a foil layer.

23. A vacuum packaged container according to claim 21, wherein the container is hermetically sealed.

24. A vacuum packaged container according to claim 21, further comprising a flexible liner having opposed end portions secured to respective ends of the tubular body wall and a free medial portion between the opposed end portions of the liner, wherein the tubular body wall defines a vent for allowing the passage of air therethrough.

* * * * *